US007932808B2

(12) United States Patent
Wobben

(10) Patent No.: US 7,932,808 B2
(45) Date of Patent: Apr. 26, 2011

(54) LOAD RESISTOR

(76) Inventor: Aloys Wobben, Aurich (DE)

( * ) Notice: Subject to any disclaimer, the term of this patent is extended or adjusted under 35 U.S.C. 154(b) by 817 days.

(21) Appl. No.: 11/632,101

(22) PCT Filed: Jul. 8, 2005

(86) PCT No.: PCT/EP2005/007419

§ 371 (c)(1),
(2), (4) Date: Nov. 29, 2007

(87) PCT Pub. No.: WO2006/005542

PCT Pub. Date: Jan. 19, 2006

(65) Prior Publication Data

US 2008/0191836 A1 Aug. 14, 2008

(30) Foreign Application Priority Data

Jul. 9, 2004 (DE) ..... 10 2004 033 680

(51) Int. Cl.
*H01C 3/00* (2006.01)

(52) U.S. Cl. ..... 338/280; 338/283

(58) Field of Classification Search ..... 338/279–284
See application file for complete search history.

(56) References Cited

U.S. PATENT DOCUMENTS

| | | | | |
|---|---|---|---|---|
| 2,725,448 A | | 11/1955 | Kintzing | 201/69 |
| 4,654,627 A | * | 3/1987 | Harkness | 338/319 |
| 5,159,310 A | | 10/1992 | Cummins et al. | 338/280 |
| 5,304,978 A | | 4/1994 | Cummins et al. | 338/280 |
| 5,488,334 A | * | 1/1996 | Wolk | 333/22 F |
| 5,917,404 A | * | 6/1999 | Campbell | 338/315 |

FOREIGN PATENT DOCUMENTS

| | | |
|---|---|---|
| EP | 0 715 317 A1 | 6/1996 |
| FR | 770 317 A | 9/1934 |
| JP | 52165248 U | 12/1977 |
| JP | 09097701 A | 4/1997 |

* cited by examiner

*Primary Examiner* — Kyung Lee

(74) *Attorney, Agent, or Firm* — Seed IP Law Group PLLC

(57) ABSTRACT

A high-performance resistor includes resistor elements electrically connected in series and each having a first and second side and a first and second end. At the first end is a first connection and provided at the second end is a second connection for connecting the resistor elements. The first and second connections each have an inner portion and an outer portion. The inner portion of the first connection is bent at a predetermined angle with respect to the first side of the resistor element. The outer portion of the first connection is in a plane which is substantially parallel to the plane of the resistor element. The inner portion of the second connection is bent at a predetermined angle with respect to the second side of the resistor element. The outer portion of the second connection is in a plane which is substantially parallel to the plane of the resistor element.

16 Claims, 6 Drawing Sheets

LOAD RESISTOR

BACKGROUND OF THE INVENTION

1. Field of the Invention

The present invention concerns a high-performance resistor having a plurality of resistor elements which are electrically connected in series.

2. Description of the Related Art

In the case of known high-performance resistors as are shown in simplified form in FIG. 5 and of which a portion is shown in FIG. 6, different connections are provided depending on the respective placement of a resistor element within the resistor. The two outer elements of which one can be seen in FIG. 6 have a straight connection 6 and a connection which is angled over once and which is bent over substantially at a right angle. The other resistor elements have two respective connection tabs which are each bent over once at a right angle but which are bent over in opposite directions.

As can be seen from FIG. 5 therefore, to produce a high-performance resistor, four different kinds of resistor elements are required. These are a start and an end element 2, 3 as well as a predeterminable number of right-hand and left-hand intermediate elements 4, 5. While the intermediate elements 4, 5 are provided with two connections which are bent over in opposite directions, the start and end elements 2, 3 each have a straight connection for connection to a circuit and a connection which is bent over at a right angle for connection to an adjacent resistor element. Depending on the respective installation situation, the bent-over connection is bent over towards the left or towards the right.

As adjacent resistor elements are connected together at the connections which are bent over at a right angle, the length of the bent-over portion determines the spacing of the adjacent resistor elements relative to each other. Here therefore the competing requirements are a structural configuration which is compact as possible (without having regard to thermal aspects) and an arrangement of the resistor elements, which is as assembly-friendly as possible. On the one hand, the spacing between adjacent resistor elements should be as small as possible in the interests of a compact design configuration, but on the other hand a greater spacing between adjacent resistor elements is more assembly-friendly than a smaller spacing.

U.S. Pat. No. 2,647,978 discloses a high-performance resistor having a plurality of resistor elements which are electrically connected in series. The resistor elements are connected together by way of bars. Provided at each of the two ends of the resistor elements is a respective element, the connection being at a right angle to the resistor element. A respective connecting portion is fixed to that connection, resistor elements being connected together by means of the connecting portions by way of the bars.

U.S. Pat. No. 2,662,958 also discloses a high-performance resistor with a plurality of resistor elements electrically connected in series. At their two ends the resistor elements have respective connections for connecting the resistor elements.

BRIEF SUMMARY OF THE INVENTION

The object of the invention is to provide a compact and at the same time assembly-friendly high-performance resistor.

In one embodiment, a high-performance resistor includes a plurality of resistor elements which are electrically connected in series and each having a first and a second side and a first and a second end, wherein provided at the first end is a first connection and provided at the second end is a second connection for connection of resistor elements, characterized in that the first and second connections each have an inner portion and an outer portion, wherein the inner portion of the first connection is bent at a predetermined angle with respect to the first side of the resistor element and the outer portion of the first connection is in a plane which is substantially parallel to the plane of the resistor element, and wherein the inner portion of the second connection is bent at a predetermined angle with respect to the second side of the resistor element and the outer portion of the second connection is in a plane which is substantially parallel to the plane of the resistor element.

In that case the invention is based on the realization that, in the configuration according to the invention, the spacing of the connections at one side of the resistor elements and thus the space available in the assembly procedure between adjacent connections is doubled to twice the plate spacing. That provides that assembly is remarkably facilitated, while the spacing between the resistor elements remains the same and thus the high-performance resistor is of the same structural size.

In a preferred embodiment, the connections are displaced by a predetermined dimension on both sides with respect to the longitudinal axis of the resistor element. The fact therefore that one of the connections is a predetermined dimension above the longitudinal axis and the other is the same dimension below the longitudinal axis means that it is possible to construct a high-performance resistor according to the invention from similar standard resistor elements, by virtue of a suitable arrangement of the individual resistor elements.

In the above-described manner, there is provided a high-performance resistor which can be advantageously used as a load resistor (dump load) in the case of energy producers, in particular wind power installations. For that purpose a plurality of high-performance resistors can be arranged in cabinets or other suitable apparatus racks in order thus to achieve dimensioning for a sufficiently high permissible power dissipation.

BRIEF DESCRIPTION OF THE SEVERAL VIEWS OF THE DRAWINGS

The invention is described in greater detail hereinafter with reference to the Figures in which.

DETAILED DESCRIPTION OF THE INVENTION

Figure 1:
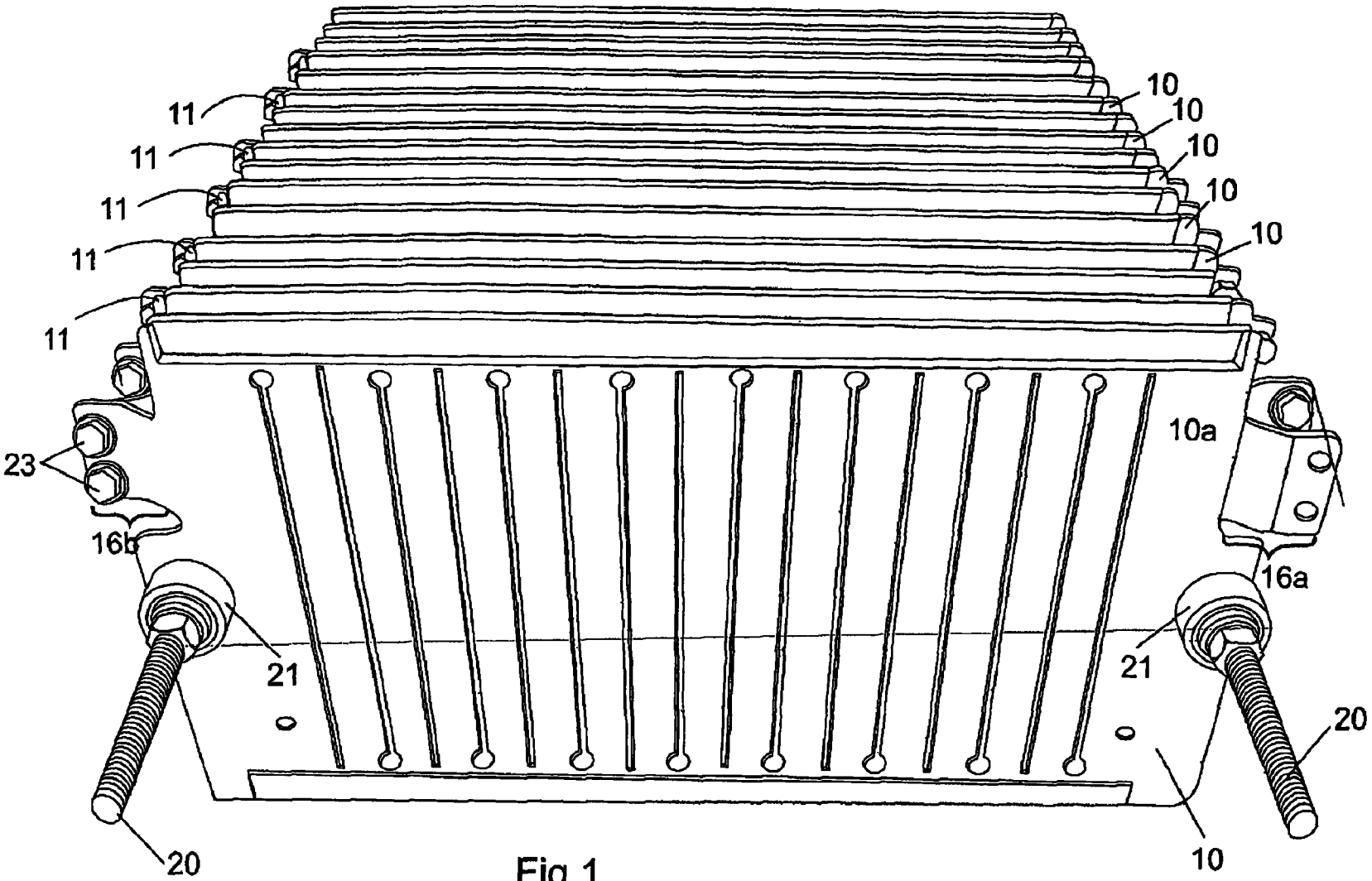
FIG. 1 shows a perspective view of a first embodiment of a high-performance resistor according to the invention.

FIG. 1 shows a perspective view of a first embodiment of a high-performance resistor. That high-performance resistor comprises first resistor elements 10 and second resistor elements 11 which are arranged alternately one behind the other. The structural configuration of the high-performance resistor, which is shown in this Figure, is achieved by the resistor elements 10, 11 being threaded on to holders 20 which here are in the form of screwthreaded rods. Spacer portions 21 are provided in order to be able to fixedly install the resistor elements. Those spacer portions 21 comprise an insulating material and simultaneously insulate the resistor elements 10, 11 from the holder 20. That can be effected in known manner by for example a short extension of a spacer portion of a smaller diameter than that visible in the Figure engaging into a bore of correspondingly large size in each of the resistor elements 10, 11 so that the resistor element rests on the extension (not shown) of the spacer portion (21) therearound and is thereby insulated from the holder 20. It will be appreciated that the insulation can also be afforded by one or more suitable sleeves fitted on to the holders.

The electrical connection of the resistor elements 10, 11 to each other is effected by means of screw connecting means at the connections 16, in which respect other electrically conducting connection means are also possible. That can be clearly seen in relation to the foremost resistor element 10. A connection 16 is free in the view at the right-hand side. That serves for the electrical connection of the high-performance resistor. For example, cables or other suitable counterpart portions can be easily connected thereto. The left-hand connection 16 of that front resistor element 10 is connected by means of fasteners, such as the two screws 23, to the corresponding connection 16 of the subsequent resistor element 11. The connection of the individual resistor elements 10, 11 with each other to afford the high-performance resistor according to the invention can be clearly seen from FIG. 2.

The first and second resistor elements 10, 11 in this case are of such a configuration that at their two ends they have a respective connection 16*a*, 16*b*, wherein one of the connections 16*a* is bent towards one side 10*a* and the other connection 16*b* is bent towards the other side 10*b*. Preferably the connections 16*a*, 16*b* have an inner and an outer portion. In that respect, the inner portion is respectively bent towards a first or a second side of the resistor element and the outer portion is then again of a configuration such as to be substantially parallel to the respective resistor element. The parallel configuration of the outer portions of the connections 16*a*, 16*b* substantially simplifies assembly of the respective resistor elements.

Figure 2:
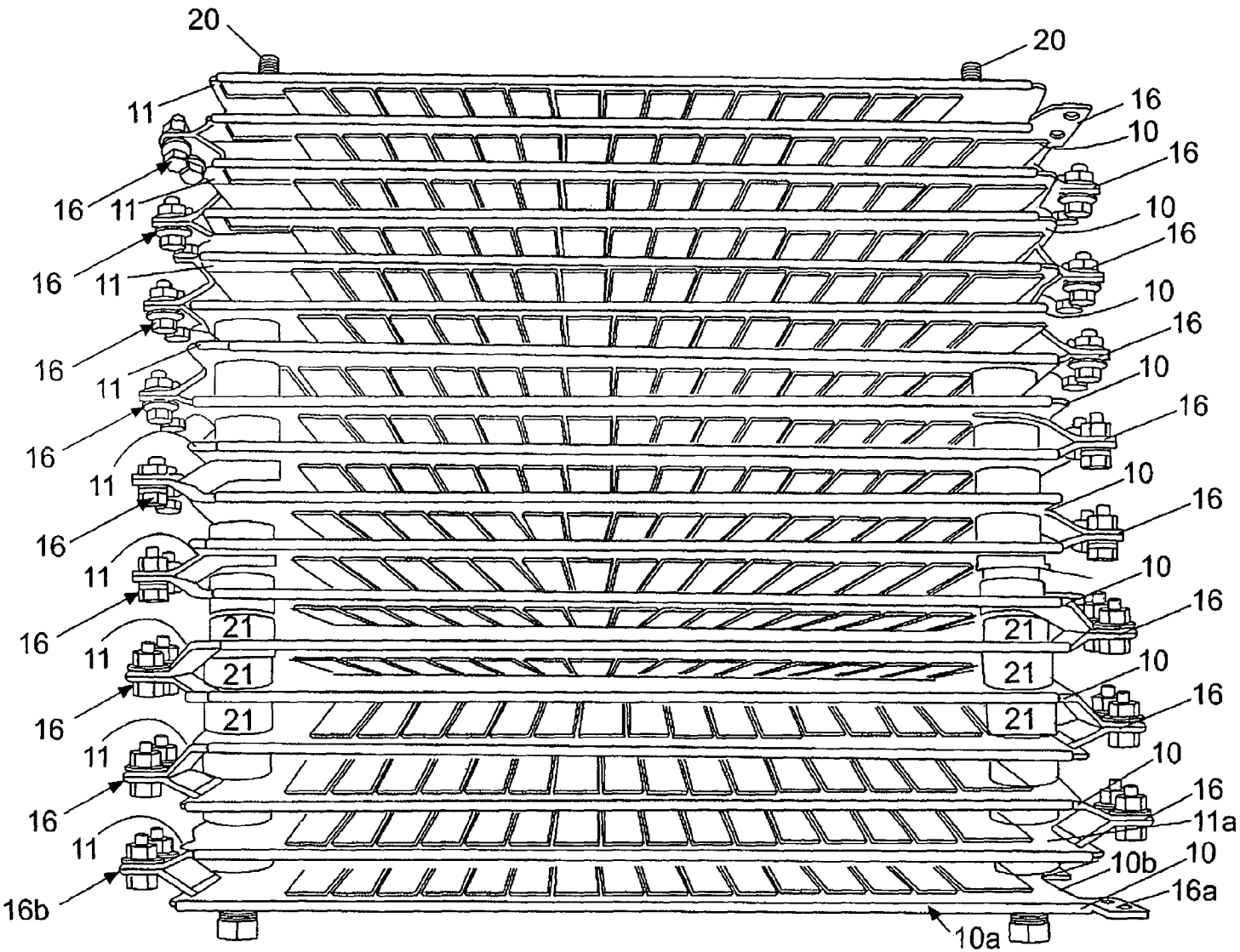
FIG. 2 shows a plan view of the high-performance resistor shown in FIG. 1.

FIG. 2 shows a plan view of a high-performance resistor according to the invention. Beginning from the lower edge of the view, first resistor elements 10 and second resistor elements 11 are arranged alternately and are mechanically connected together by means of holders 20 and spacer portions 21. Apart from the two outer resistor elements, the adjacent resistor elements 10, 11 are connected together by screws at the respective mutually facing connections 16. That affords electrically a series connection of the individual resistor elements 10, 11. At their side which is at the right in this Figure, the two outer resistor elements each have a free connection 16 at which they can be connected to the electric feed lines.

It can also be clearly seen from FIG. 2 that the intermediate space between adjacent connections at one side of the high-performance resistor corresponds to double the spacing between adjacent resistor elements.

Figure 3:
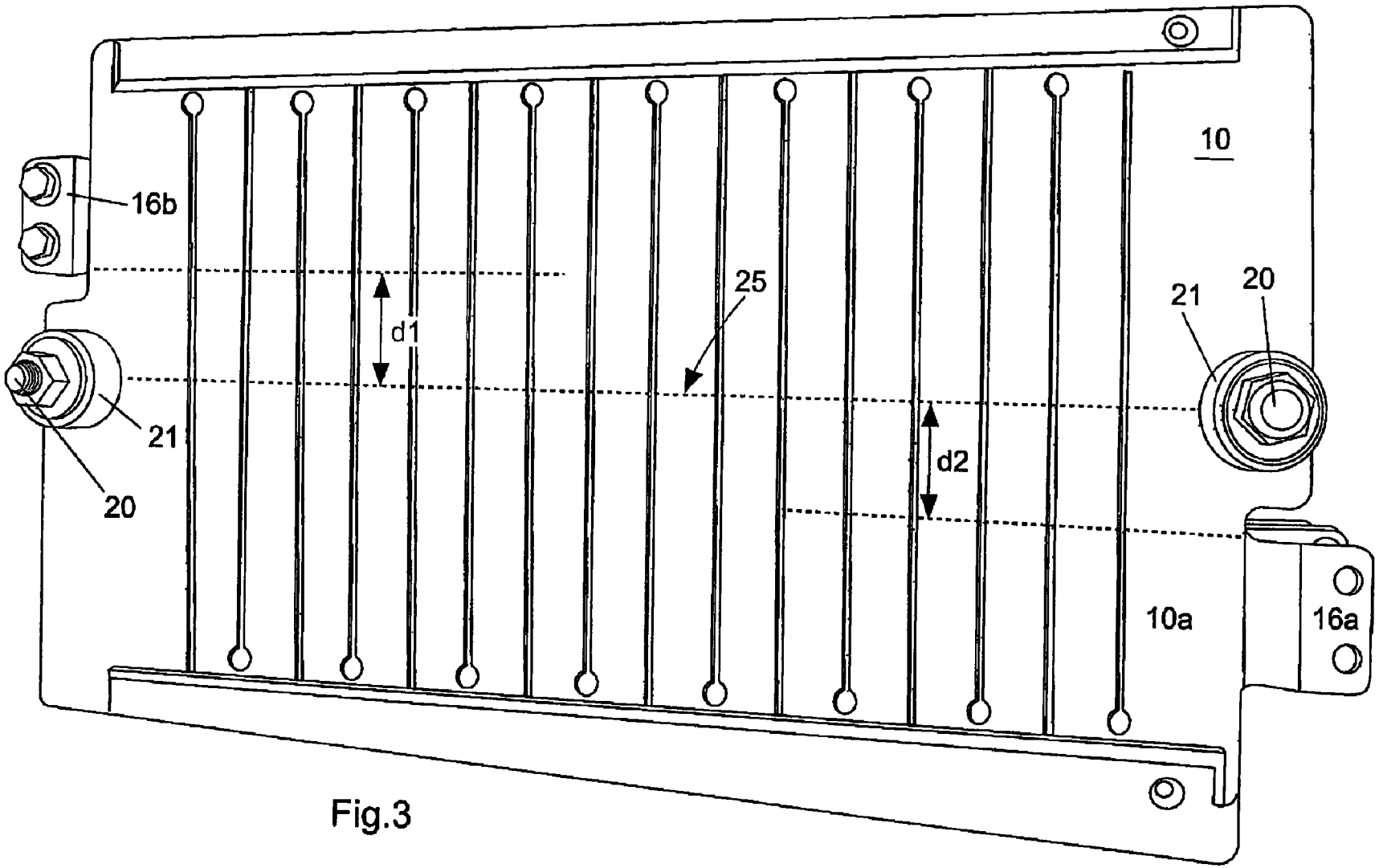
FIG. 3 shows a front view of a second embodiment of a high-performance resistor according to the invention.

FIG. 3 shows a further embodiment of a resistor element according to the invention. That resistor element 10 differs from that of the first embodiment by the arrangement of the connections 16. These connections 16 are displaced by a predetermined dimension d1, d2 with respect to the illustrated longitudinal axis 25 of the resistor element 10, that is to say one connection is arranged above the longitudinal axis and one is arranged below it. The further structure substantially corresponds to the structure in the preceding embodiment. It will be appreciated that this embodiment also has holders 20 and spacer portions 21. Furthermore, in this embodiment, adjacent resistor elements are also connected together by screws at the connections 16 to produce an electrical connection. It can be clearly seen from this Figure that the connection 16 in the left-hand region of the Figure is disposed above the holder 20, while the connection 16 in the right-hand region of the Figure is disposed by the same dimension below the corresponding holder 20.

Figure 4:
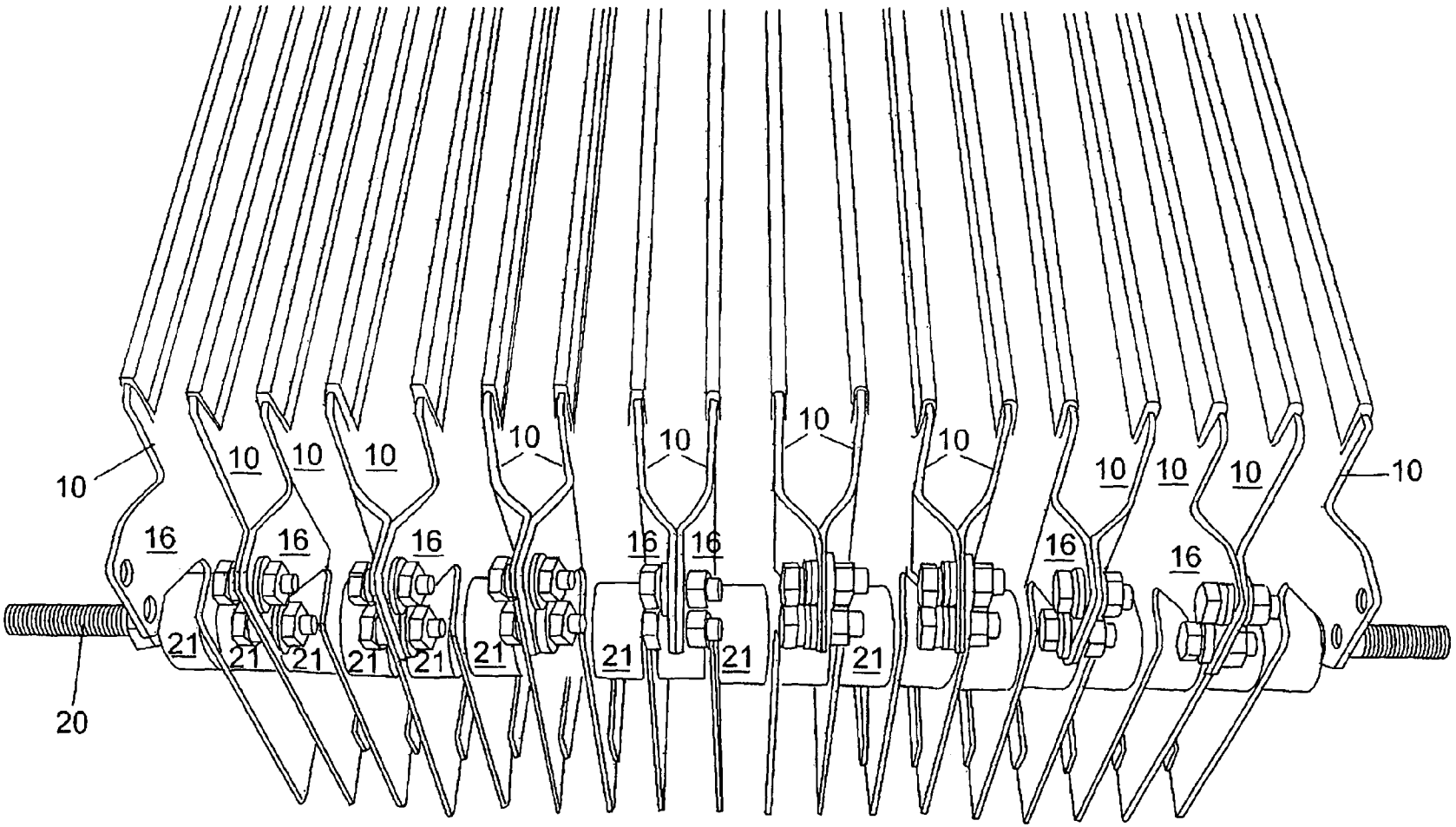
FIG. 4 shows a perspective side view of the high-performance resistor shown in FIG. 3.
Figure 5:
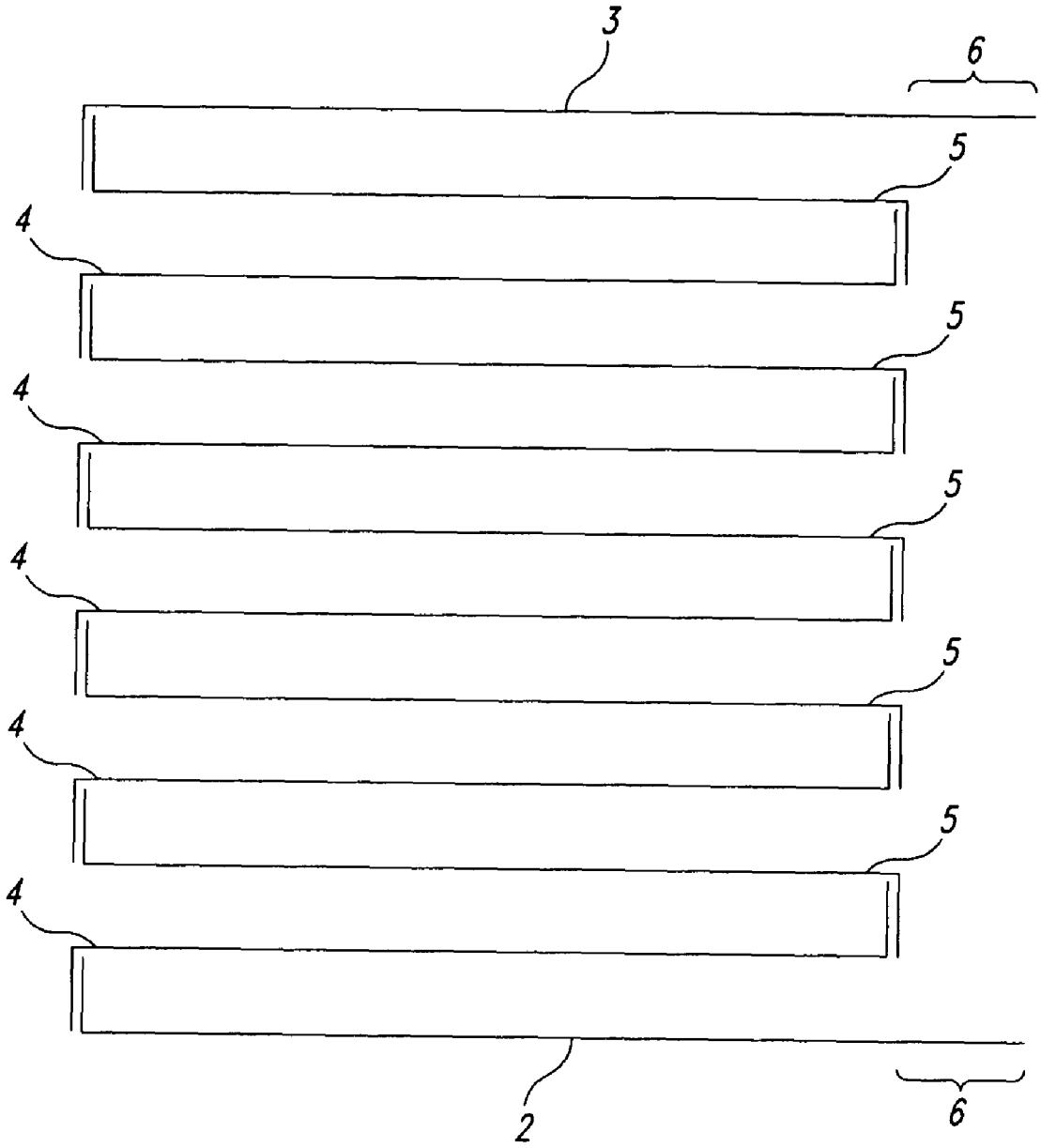
FIG. 5 (Prior Art)
FIG. 5 shows a simplified plan view of a known high-performance resistor.
Figure 6:
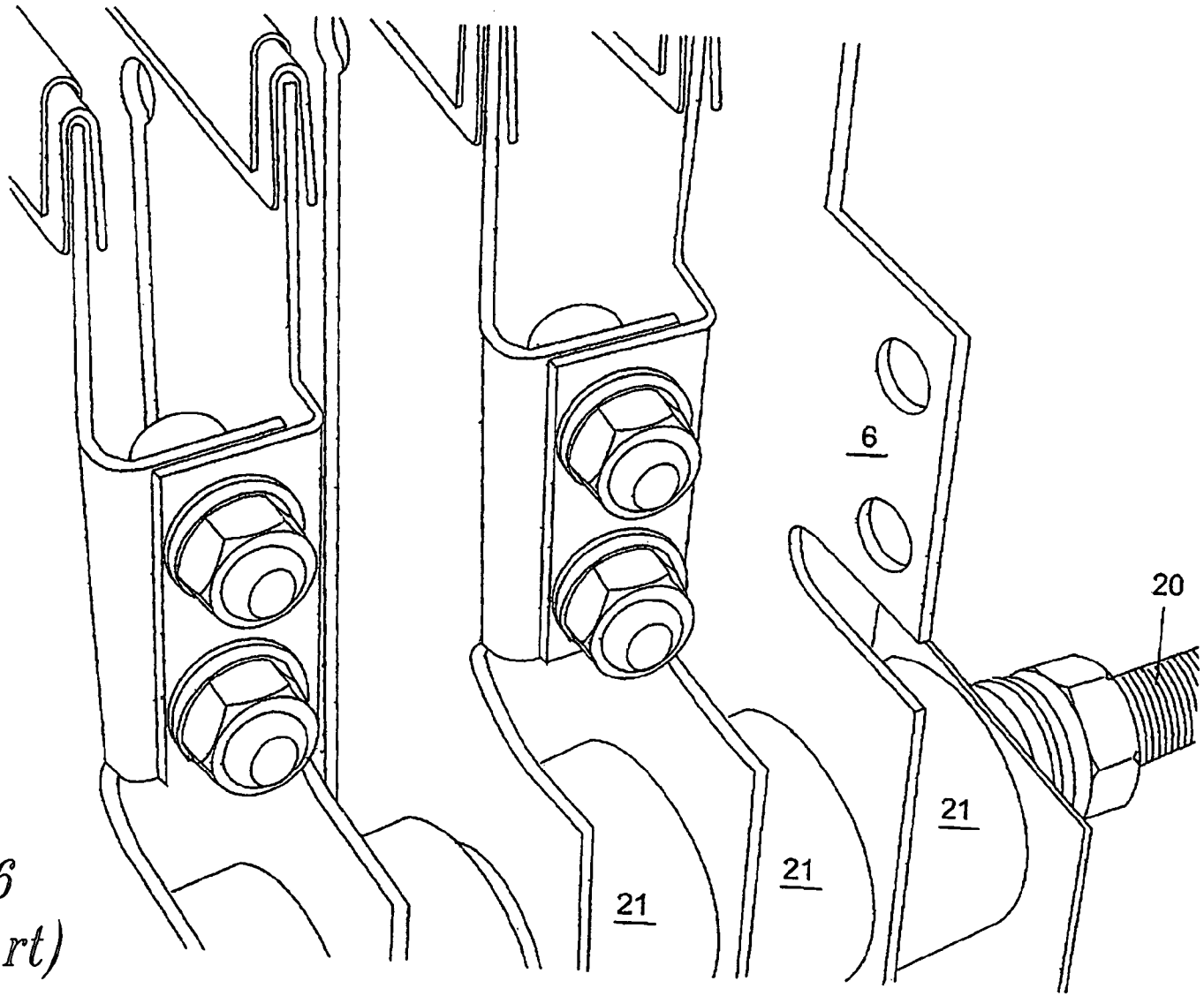
FIG. 6 (Prior Art)
FIG. 6 shows details of the known high-performance resistor.

FIG. 4 shows a side view of a high-performance resistor of this second embodiment of the present invention. It is possible once again to clearly see therefrom the spacer portions 21 which, together with the holder 20, form the mechanical connection of the resistor elements 10 with each other. It can also be clearly seen from this Figure that the electrical connections are again made by screw connections at the connections 16, wherein the connections 16 at the two outer resistor elements are free in order to permit electric lines to be connected thereto.

The crucial difference in relation to the first embodiment is that here only one single resistor element 10 is also required to construct a resistor according to the invention. That derives from the displaced arrangement of the connections 16 with respect to the centre line of the resistor element 10. That displaced arrangement makes it possible for the resistor elements to be connected by a suitably oriented arrangement in accordance with the invention to provide a high-performance resistor.

As described hereinbefore, preferably flat resistor elements are provided in accordance with the invention. The resistor elements are preferably all of the same or identical structure. The above-described high-performance resistor can advantageously be used as a load resistor in the cabinets of the power electronics of a wind power installation or in a separate apparatus rack in a wind power installation in order to be used as a dump load. In that respect the dimensioning of the high-performance resistors is such that a sufficiently high level of permissible power dissipation can be achieved.

If the power generated by the electrical generator of the wind power installation cannot be delivered to a network or is not to be delivered, that electrical power is dissipated entirely or partially by way of the high-performance resistor. Rapid power regulation can thus be effected. As a power regulation of that kind involves electrical regulation, adjustment of the pitch angle of the rotor blades of the wind power installation is not absolutely necessary for the time being.

The high-performance resistor or a plurality of high-performance resistors is preferably arranged in the proximity of the inverter of the wind power installation.

All of the above U.S. patents, U.S. patent application publications, U.S. patent applications, foreign patents, foreign patent applications and non-patent publications referred to in this specification and/or listed in the Application Data Sheet, including but not limited to German Application No. 04 033 680 6, filed on Jul. 9, 2004, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A high-performance resistor, comprising:

a plurality of resistor elements which are electrically connected in series, each resistor element having a first side, a second side opposing the first side, a first end, a second end, a first bore adjacent the first end and a second bore adjacent the second end;

a first connection having an inner portion and an outer portion, wherein the inner portion of the first connection is attached to the first end of the resistor element and extends outward at a first angle with respect to the first side of the resistor element, and wherein the outer portion of the first connection is substantially parallel to the first side of the resistor element; and a second connection having an inner portion and an outer portion, wherein the inner portion of the second connection is attached to the second end of the resistor element and extends outward at a second angle with respect to the second side of the resistor element, wherein the outer portion of the second connection is substantially parallel to the second side of the resistor element, and wherein the second connection is operable to couple to the first connection of an adjacent resistor element;

a first holder;

a second holder; and a plurality of spacers having a hole therethrough, wherein the first holder extends through the first bore of each of the resistor elements and the hole of each spacer of a first group of the spacers such that there is at least one spacer between adjacent resistor elements, wherein the second holder extends through the second bore of each of the resistor elements and the hole of each spacer of a second group of the spacers such that there is at least one spacer between adjacent resistor elements, and wherein the at least one spacer between adjacent resistor elements physically separates and electrically isolates each of the resistor elements from adjacent resistor elements, and electrically isolates the respective holder from the resistor elements.

2. The high-performance resistor according to claim 1 wherein the first connection of each resistor element is displaced by a first dimension with respect to a longitudinal axis of the resistor element and the second connection is displaced by a second dimension with respect to the longitudinal axis of the resistor element.

3. The high-performance resistor according to claim 1 wherein the high-performance resistor is operable as a load resistor for a wind power installation.

4. The high-performance resistor according to claim 1, further comprising:

a plurality of fasteners operable to attach the outer portion of the first connection of one of the resistor elements to the outer portion of the second connection of an adjacent resistor element, and operable to electrically connect the resistor element to the adjacent resistor element.

5. The high-performance resistor according to claim 1 wherein the outer portion of the first connection of a first one of the resistor elements of the series coupled resistor elements is coupled to a first electrical line, and wherein the outer portion of the second connection of a last one of the resistor elements of the series coupled resistor elements is coupled to a second electrical line, such that the high-performance resistor is operable as a load resistor.

6. The high-performance resistor according to claim 5 wherein the first electrical line and the second electrical line are electrically coupled to at least one generator driven by a wind power installation.

7. The high-performance resistor according to claim 1 wherein the inner portion of the first connection is bent outward from the first side of the resistor element at the first angle, and wherein the inner portion of the second connection is bent outward from the second side of the resistor element at the second angle.

8. The high-performance resistor according to claim 7 wherein the outer portion of the first connection is bent from the inner portion of the first connection so as to be substantially parallel to the first side of the resistor element, and wherein the outer portion of the second connection is bent from the inner portion of the second connection so as to be substantially parallel to the second side of the resistor element.

9. The high-performance resistor according to claim 1 wherein the first angle is substantially the same as the second angle.

10. The high-performance resistor according to claim 1 wherein the first connection is displaced from the first bore by a first dimension and the second connection is displaced from the second bore by a second dimension.

11. The high-performance resistor according to claim 10 wherein the first dimension is the same as the second dimension.

12. The high-performance resistor according to claim 10 wherein the first connection is above the first bore by the first dimension and the second connection is below the second bore by the second dimension.

13. The high-performance resistor according to claim 1 wherein the first and the second holders rigidly fix the plurality of resistor elements in position with respect to each other.

14. A high-performance resistor, comprising:

a plurality of resistor elements which are electrically connected in series, each resistor element having a first side, a second side opposing the first side, a first end, a second end, a first bore adjacent the first end and a second bore adjacent the second end, and each of the resistor elements further including a first connection and a second connection wherein the second connection is configured to couple to the first connection of an adjacent resistor element;

a first holder;

a second holder; and a plurality of spacers having a hole therethrough, wherein the first holder extends through the first bore of each of the resistor elements and the hole of each spacer of a first group of the spacers such that there is at least one spacer between adjacent resistor elements, wherein the second holder extends through the second bore of each of the resistor elements and the hole of each spacer of a second group of the spacers such that there is at least one spacer between adjacent resistor elements, and wherein the at least one spacer between adjacent resistor elements physically separates and electrically isolates each of the resistor elements from adjacent resistor elements, and electrically isolates the respective holder from the resistor elements.

15. The high-performance resistor according to claim 14 wherein the first connection has an inner portion and an outer portion, the inner portion of the first connection attached to the first end of the resistor element and extending outward at a first angle with respect to the first side of the resistor element, and the outer portion of the first connection substantially parallel to the first side of the resistor element, and wherein the second connection has an inner portion and an outer portion, the inner portion of the second connection attached to the second end of the resistor element and extending outward at a second angle with respect to the second side of the resistor element, the outer portion of the second connection substantially parallel to the second side of the resistor element.

16. The high-performance resistor according to claim 14 wherein the first and the second holders rigidly fix the plurality of resistor elements in position with respect to each other.

* * * * *